US008282435B2

(12) United States Patent
Espiau

(10) Patent No.: US 8,282,435 B2
(45) Date of Patent: Oct. 9, 2012

(54) METHOD AND SYSTEM FOR REPLACING A PLASMA LAMP FROM A RESONATOR ASSEMBLY

(75) Inventor: Frederick M. Espiau, Topanga, CA (US)

(73) Assignee: Topanga Technologies, Inc., Canoga Park, CA (US)

( * ) Notice: Subject to any disclaimer, the term of this patent is extended or adjusted under 35 U.S.C. 154(b) by 196 days.

(21) Appl. No.: 12/720,603

(22) Filed: Mar. 9, 2010

(65) Prior Publication Data

US 2011/0204808 A1 Aug. 25, 2011

Related U.S. Application Data

(60) Provisional application No. 61/158,701, filed on Mar. 9, 2009.

(51) Int. Cl.
*H01J 9/50* (2006.01)

(52) U.S. Cl. ..... 445/2; 313/634; 313/161

(58) Field of Classification Search ..... 313/153–162, 313/231.31, 231.41, 231.51, 231.61, 231.7
See application file for complete search history.

(56) References Cited

U.S. PATENT DOCUMENTS 4,498,029 A * 2/1985 Yoshizawa et al. ..... 315/39
4,975,655 A 12/1990 Dawson et al.
5,637,963 A 6/1997 Inoue et al.
5,686,793 A 11/1997 Turner et al.
5,777,857 A 7/1998 Degelmann
5,834,895 A 11/1998 Dolan et al.
5,838,108 A 11/1998 Frank et al.
5,886,480 A 3/1999 Penzenstadler et al.
5,923,122 A 7/1999 Frank et al.
6,137,237 A 10/2000 MacLennan et al.
6,241,369 B1 6/2001 Mackiewicz
6,323,601 B1 * 11/2001 Klein et al. ..... 315/248
6,617,806 B2 9/2003 Kirkpatrick et al.
6,737,809 B2 5/2004 Espiau et al.

(Continued)

OTHER PUBLICATIONS

Notice of Allowance for U.S. Appl. No. 12/484,933, mailed on Jul. 23, 2010, 6 pages.

(Continued)

*Primary Examiner* — Mariceli Santiago
*Assistant Examiner* — Donald Raleigh
(74) *Attorney, Agent, or Firm* — Kilpatrick Townsend & Stockton LLP

(57) ABSTRACT

A plasma lamp. The lamp includes a housing having a spatial volume defined within the housing. In a specific embodiment, the spatial volume has an inner region and an outer region. The lamp also has a support region coupled to the inner region of the spatial volume and a support body having an outer surface region slidably inserted and disposed within or partially disposed the support region. In a preferred embodiment, the support body has a support length, a support first end, and a support second end. The plasma lamp has a gas-filled vessel coupled to the support first end of the support body. In a preferred embodiment, the gas filled vessel has a transparent or translucent body, an inner surface and an outer surface, a cavity formed within the inner surface. In a preferred embodiment, the cavity is sealed and includes a fill material, which is capable of discharge. The lamp has an rf source operably coupled to at least the first end of the gas-filled vessel. In a specific embodiment, the rf source is configured to cause a discharge of one or more gases in the gas filled vessel.

11 Claims, 4 Drawing Sheets

U.S. PATENT DOCUMENTS

| | | | |
|---|---|---|---|
| 6,922,021 | B2 | 7/2005 | Espiau et al. |
| 7,119,641 | B2 | 10/2006 | Petrov et al. |
| 7,291,785 | B2 | 11/2007 | Riester et al. |
| 7,348,732 | B2 | 3/2008 | Espiau et al. |
| 7,350,936 | B2 | 4/2008 | Ducharme et al. |
| 7,358,678 | B2 | 4/2008 | Espiau et al. |
| 7,362,054 | B2 | 4/2008 | Espiau et al. |
| 7,362,055 | B2 | 4/2008 | Espiau et al. |
| 7,362,056 | B2 | 4/2008 | Espiau et al. |
| 7,372,209 | B2 | 5/2008 | Espiau et al. |
| 7,391,158 | B2 | 6/2008 | Espiau et al. |
| 7,719,195 | B2 | 5/2010 | DeVincentis et al. |
| 7,830,092 | B2 | 11/2010 | Espiau et al. |
| 2006/0250090 | A9 | 11/2006 | Guthrie |
| 2007/0222352 | A1 * | 9/2007 | DeVincentis et al. ... 313/231.71 |
| 2008/0054813 | A1 | 3/2008 | Espiau et al. |
| 2009/0322240 | A1 | 12/2009 | Espiau et al. |

OTHER PUBLICATIONS

Bogaerts, et al., "Gas Discharge Plasmas and their Applications," Spectrochimica Acta, Part B 57, 2002, pp. 609-658.

International Search Report and Written Opinion of PCT Application No. PCT/US2009/048174, dated Aug. 17, 2009, 17 pages total.

* cited by examiner

METHOD AND SYSTEM FOR REPLACING A PLASMA LAMP FROM A RESONATOR ASSEMBLY

CROSS-REFERENCES TO RELATED APPLICATIONS

This application claims priority to U.S. Provisional Application No. 61/158,701, filed on Mar. 9, 2009, commonly assigned, and incorporated by reference herein for all purpose. This application is also related to U.S. patent application Ser. No. 12/484,933, filed on Jun. 15, 2009 and PCT Application Serial No. PCT/US2009/048171, filed on Jun. 22, 2009, commonly assigned, and incorporated by reference herein for all purpose.

BACKGROUND OF THE INVENTION

The present invention relates generally to lighting techniques. In particular, the present invention provides a method and device using a plasma lighting device having one of a plurality of base configurations. More particularly, the present invention provides a method and resulting system for removing and preferably replacing a plasma bulb for a lighting device, which can be used for a variety of applications. Merely by way of example, such plasma lamps can be applied to applications such as stadiums, security, parking lots, military and defense, streets, large and small buildings, vehicle headlamps, aircraft landing, bridges, warehouses, uv water treatment, agriculture, architectural lighting, stage lighting, medical illumination, microscopes, projectors and displays, any combination of these, and the like.

From the early days, human beings have used a variety of techniques for lighting. Early humans relied on fire to light caves during hours of darkness. Fire often consumed wood for fuel. Wood fuel was soon replaced by candles, which were derived from oils and fats. Candles were then replaced, at least in part by lamps. Certain lamps were fueled by oil or other sources of energy. Gas lamps were popular and still remain important for outdoor activities such as camping. In the late 1800, Thomas Edison, who is the greatest inventor of all time, conceived the incandescent lamp, which uses a tungsten filament within a bulb, coupled to a pair of electrodes. Many conventional buildings and homes still use the incandescent lamp, commonly called the Edison bulb. Although highly successful, the Edison bulb consumed much energy and was generally inefficient.

Fluorescent lighting replaced incandescent lamps for certain applications. Fluorescent lamps generally consist of a tube containing a gaseous material, which is coupled to a pair of electrodes. The electrodes are coupled to an electronic ballast, which helps ignite the discharge from the fluorescent lighting. Conventional building structures often use fluorescent lighting, rather than the incandescent counterpart. Fluorescent lighting is much more efficient than incandescent lighting, but often has a higher initial cost.

Shuji Nakamura pioneered the efficient blue light emitting diode, which is a solid state lamp. The blue light emitting diode forms a basis for the white solid state light, which is often a blue light emitting diode within a bulb coated with a yellow phosphor material. Blue light excites the phosphor material to emit white lighting. The blue light emitting diode has revolutionized the lighting industry to replace traditional lighting for homes, buildings, and other structures.

Another form of lighting is commonly called the electrode-less lamp, which can be used to discharge light for high intensity applications. Matt was one of the pioneers that developed an improved electrode-less lamp. Such electrode-less lamp relied upon a solid ceramic resonator structure, which was coupled to a fill enclosed in a bulb. The bulb was coupled to the resonator structure via rf feeds, which transferred power to the fill to cause it to discharge high intensity lighting. Although somewhat successful, the electrode-less lamp still had many limitations. As an example, electrode-less lamps have not been successfully deployed. Additionally, electrode-less lamps are generally difficult to disassemble and assembly leading to inefficient use of such lamps. These and other limitations may be described throughout the present specification and more particularly below.

From the above, it is seen that improved techniques for lighting are highly desired.

BRIEF SUMMARY OF THE INVENTION

According to the present invention, techniques for lighting are provided. In particular, the present invention provides a method and device using a plasma lighting device having one of a plurality of base configurations. Merely by way of example, such plasma lamps can be applied to applications such as stadiums, security, parking lots, military and defense, streets, large and small buildings, vehicle headlamps, aircraft landing, bridges, warehouses, uv water treatment, agriculture, architectural lighting, stage lighting, medical illumination, microscopes, projectors and displays, any combination of these, and the like.

In a specific embodiment, the present invention provides a plasma lamp. The lamp includes a housing having a spatial volume defined within the housing. In a specific embodiment, the spatial volume has an inner region and an outer region. The lamp also has a support region coupled to the inner region of the spatial volume and a support body having an outer surface region slidably inserted and disposed within or partially disposed the support region. In a preferred embodiment, the support body has a support length, a support first end, and a support second end. The plasma lamp has a gas-filled vessel coupled to the support first end of the support body. In a preferred embodiment, the gas filled vessel has a transparent or translucent body, an inner surface and an outer surface. A cavity is formed within the inner surface, e.g., glass bulb, quartz bulb. In a preferred embodiment, the cavity is sealed and includes a fill material, which is capable of discharge. The lamp has an rf source operably coupled to at least the first end of the gas-filled vessel. In a specific embodiment, the rf source is configured to cause a discharge of one or more gases in the gas filled vessel.

In an alternative specific embodiment, the present invention provides a method of replacing a bulb on plasma lamps. The method includes providing a plasma lamp apparatus comprising a housing having a spatial volume defined within the housing. In a specific embodiment, the spatial volume has an inner region and an outer region. In a preferred embodiment, the plasma lamp assembly also has a support region coupled to the inner region of the spatial volume. The method includes removing a first lamp device comprising a first gas filled vessel coupled to a first support body disposed within or partially disposed the support region of the housing. The method also inserts inserting a second lamp device comprising a second gas filled vessel coupled to a second support body to a region within or partially within the support region of the inner region of the spatial volume of the housing. The method couples the second support body to the housing to firmly engage the second lamp device to the support region of the plasma lamp assembly. As used herein, the terms "first"

and "second" are not intended to imply order and should be interpreted broadly as one of ordinary skill in the art.

Benefits are achieved over pre-existing techniques using the present invention. In a preferred embodiment, the present apparatus and method includes a replaceable gas filled vessel, including a support body, for easy repair and maintenance. In a specific embodiment, the present invention provides a method and device having configurations of input, output, and feedback coupling elements that provide for electromagnetic coupling to the bulb whose power transfer and frequency resonance characteristics that are largely independent of the conventional dielectric resonator, but can also be dependent upon conventional designs. In a preferred embodiment, the present invention provides a method and configurations with an arrangement that provides for improved manufacturability as well as design flexibility. Other embodiments may include integrated assemblies of the output coupling element and bulb that function in a complementary manner with the present coupling element configurations and related methods for street lighting applications. Still further, the present method and device provide for improved heat transfer characteristics, as well as further simplifying manufacturing and/or retrofitting of existing and new street lighting, such as lamps, and the like. In a specific embodiment, the present method and resulting structure are relatively simple and cost effective to manufacture for commercial applications. Depending upon the embodiment, one or more of these benefits may be achieved. These and other benefits may be described throughout the present specification and more particularly below.

The present invention achieves these benefits and others in the context of known process technology. However, a further understanding of the nature and advantages of the present invention may be realized by reference to the latter portions of the specification and attached drawings.

DETAILED DESCRIPTION OF THE INVENTION

According to the present invention, techniques for lighting are provided. In particular, the present invention provides a method and device using a plasma lighting device having one of a plurality of base configurations. Merely by way of example, such plasma lamps can be applied to applications such as stadiums, security, parking lots, military and defense, streets, large and small buildings, vehicle headlamps, aircraft landing, bridges, warehouses, uv water treatment, agriculture, architectural lighting, stage lighting, medical illumination, microscopes, projectors and displays, any combination of these, and the like.

Figure 1:
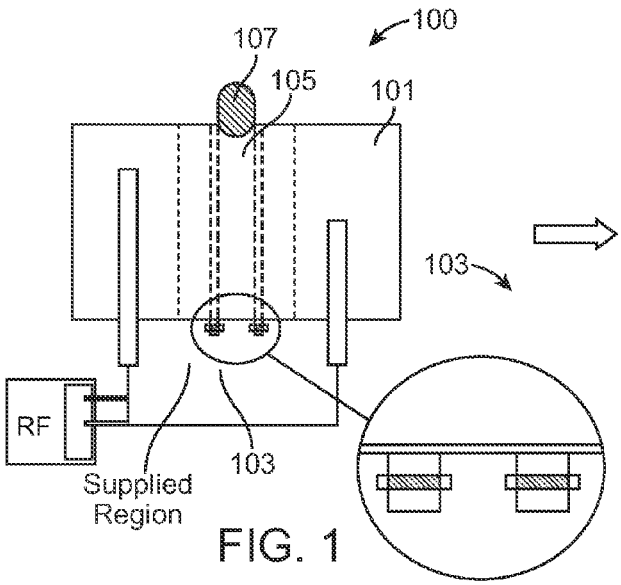
FIG. 1 is a simplified diagram of a plasma lamp device according to an embodiment of the present invention.

FIG. 1 is a simplified diagram of a plasma lamp device 100 according to an embodiment of the present invention. This diagram is merely an example, which should not unduly limit the scope of the claims herein. One of ordinary skill in the art would recognize other variations, modifications, and alternatives. As shown, the plasma lamp device has a housing 101 having a spatial volume defined within the housing. The spatial volume has an inner region and an outer region. In a specific embodiment, the housing can be made of a suitable material, which is conductive. The housing can be made of a metal, a dielectric, or a semiconductor, or any combination of these materials, including molded, welded, stamped, or other configurations. Alternatively, the housing can be made of other materials. As an example, the housing is made of aluminum, copper, plastic (which can be coated with a conductive metal material or conductive polymer), but can be others. Of course, there can be other variations, modifications, and alternatives.

In a specific embodiment, the device has a support region 103 coupled to the inner region of the spatial volume. In a specific embodiment, the support region extends to an outer region of the lower portion of the housing, as shown. In a specific embodiment, the support region includes one or more attachment devices. In a specific embodiment, the one or more attachment devices include set screws, clamps, support members, any combination of these, and other suitable devices. In a specific embodiment, the support region is a portion of the housing, but can also be a separate member attached to the housing. The support member can be made of metal, such as steel, aluminum, or copper, as well as dielectric materials, such as alumina coated with a conductive material, such as silver or others. Alternatively, a combination of materials and/or layers can be used according to other embodiments. Of course, there can be other variations, modifications and alternatives.

As shown, the device also includes a support body 105 having an outer surface region slidably inserted and disposed within or partially disposed the support region. In a specific embodiment, the support body has a support length, a support first end, and a support second end, among other features. The support body can be made of a suitable material such as a dielectric material or others. As an example, the support body can be made of an alumina material or other suitable dielectric material, but other can be other materials. Alternatively, the support body can be a conductive material, which has an overlying metal layer, according to a specific embodiment. As an example, the support body is integral or configured with the housing and made of a conductive material or the like. Of course, there can be other variations, modifications, and alternatives.

In a specific embodiment, the support member and body are configured to be attached to each other using a threaded connection. In a specific embodiment, the support member comprises a threaded portion, which couples to a threaded portion on the support body. The support member can be inserted into and screwed into the support body and firmly engaged to it using conventional threading means or the like. Of course, there can be other variations, modifications, and alternatives.

In a specific embodiment, the support body has a suitable shape and size. The support body can be inserted within the support body according to a specific embodiment. The support body can be annular in shape, and have an outer surface, which is substantially smooth and insertable into the support region. The support body also includes a seat or region for a gas filled vessel according to one or more embodiments. Further details of the gas filled vessel can be found throughout the present specification and more particularly below.

In a specific embodiment, the device also includes a gas-filled vessel 107 coupled to the support first end of the support body. The gas filled vessel has a transparent or translucent body. The body has an inner surface, an outer surface, and a cavity formed within the inner surface. In a preferred embodiment, the cavity is sealed with a fill material. In a specific embodiment, the fill material can be metal halide or other suitable species, or combinations, and the like. In a specific embodiment, the vessel can be made of quartz or other suitable transparent materials capable of enclosing a gas discharge at a high temperature. The temperature of the vessel can be fairly high without damaging the gas filled vessel according to a specific embodiment. In a specific embodiment, the vessel is made of quartz, glass, translucent alumina, or other suitable material. Of course, there can be other variations, modifications, and alternatives.

The device also has an rf source operably coupled to at least the first end of the gas-filled vessel. The rf source is configured to cause a discharge of one or more gases in the gas filled vessel. In a specific embodiment, the rf source is configured at a frequency of 1 GHz and less or 900 MHz and less or preferably 400 MHz and less. Further details of the lamp device, rf source, gas filled vessel, and other elements can be found in co-pending U.S. patent application Ser. No. 12/484,933, filed Jun. 15, 2009, and PCT Application No. PCT/US2009/048174, filed Jun. 22, 2009, both of which commonly assigned, and hereby incorporated by reference for all purposes. Again, there can be other variations, modifications, and alternatives.

Figure 2:
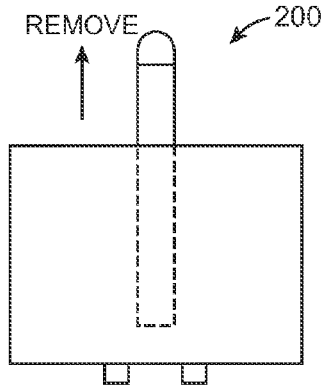
FIG. 2 is a simplified diagram of a first configuration of the gas-filled vessel for the plasma lamp according to an embodiment of the present invention.

FIG. 2 is a simplified diagram of a first configuration 200 of the gas-filled vessel for the plasma lamp according to an embodiment of the present invention. This diagram is merely an example, which should not unduly limit the scope of the claims herein. One of ordinary skill in the art would recognize other variations, modifications, and alternatives. As shown, the support body and gas filled vessel are removed together by sliding the support body from an upper region of the housing. In a specific embodiment, attachment devices engaging the support body to the support region are disengaged. After that, the support body including the vessel slides out (see "Remove") of the support region according to a specific embodiment. The vessel including the support body is free from the support body and can be replaced with another vessel and/or support body according to a specific embodiment. Of course, there can be other variations, modifications, and alternatives.

Figure 3:
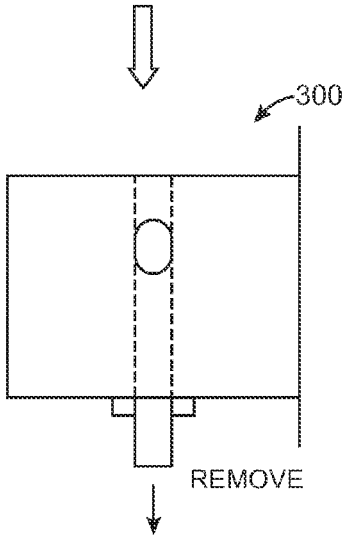
FIG. 3 is a simplified diagram of a second configuration of the gas filled vessel for the plasma lamp according to an alternative embodiment of the present invention.

FIG. 3 is a simplified diagram of a second configuration 300 of the gas filled vessel for the plasma lamp according to an alternative embodiment of the present invention. This diagram is merely an example, which should not unduly limit the scope of the claims herein. One of ordinary skill in the art would recognize other variations, modifications, and alternatives. As shown, the support body and gas filled vessel are removed together by sliding the support body from a lower region of the housing. In a specific embodiment, attachment devices capable of engaging the support body to the support region have been disengaged. After that, the support body including the vessel slides out of the support region according to a specific embodiment. The vessel including the support body is free from the support region and can be replaced with another vessel and/or support body according to a specific embodiment. Of course, there can be other variations, modifications, and alternatives.

Figure 4:
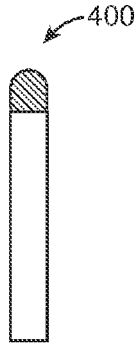
FIG. 4 is a simplified diagram of a gas filled vessel with a support body according to an embodiment of the present invention.

FIG. 4 is a simplified diagram 400 of a gas filled vessel with and without a support body according to an embodiment of the present invention. This diagram is merely an example, which should not unduly limit the scope of the claims herein. One of ordinary skill in the art would recognize other variations, modifications, and alternatives. As shown, the support body is coupled to gas-filled bulb or bulb without gas if it leaked out according to a specific embodiment. In a specific embodiment, the bulb is a transparent or translucent bulb, which is sealed with a fill material capable of discharge upon application of an rf power source. As shown, the support body can be annular in shape and have a substantially smooth exterior region. The support body also has a substantially constant cross-sectional diameter and length that is suitable for the support body according to a specific embodiment. In other embodiments, the support body can have three or more sides and/or other configurations that are suitable for supporting the bulb and being slidably insertable into the support region. Of course, there can be other variations, modifications, and alternatives.

In a specific embodiment, the support body having an outer surface region slidably inserted and disposed within or partially disposed the support region. In a specific embodiment, the support body has a support length, a support first end, and a support second end, among other features. The support body can be made of a suitable material such as a dielectric material or others. As an example, the support body can be made of any of the materials or combination of materials described herein, but can be others. Further details of the support body and bulb can be found throughout the present specification and more particularly below.

Figure 5:
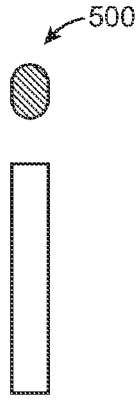
FIG. 5 is a simplified diagram of a gas filled vessel without a support body according to an embodiment of the present invention.

FIG. 5 is a simplified diagram 500 of a gas filled vessel without a support body according to an embodiment of the present invention. This diagram is merely an example, which should not unduly limit the scope of the claims herein. One of ordinary skill in the art would recognize other variations, modifications, and alternatives. As shown, the support body is decoupled from the vessel. As shown, the support body is decoupled from the gas filled vessel or bulb according to a specific embodiment. As shown, the leaky or bad bulb can be replaced with a new or operational bulb according to a specific embodiment. Details of replacing the gas-filled vessel can be found below.

Figure 6:
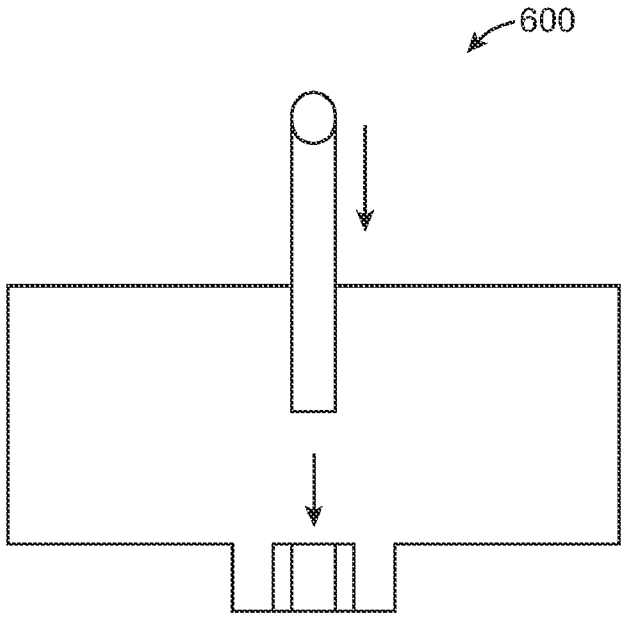
FIG. 6 is a simplified diagram of a third configuration of the gas filled vessel for the plasma lamp according to an alternative embodiment of the present invention.

FIG. 6 is a simplified diagram 600 of a third configuration of the gas filled vessel for the plasma lamp according to an alternative embodiment of the present invention. This diagram is merely an example, which should not unduly limit the scope of the claims herein. One of ordinary skill in the art would recognize other variations, modifications, and alternatives. As shown, the support body and gas filled vessel are inserted together by sliding the support body through the upper region of the housing. In a specific embodiment, attachment devices that have been disengaged from the support member are engaged. After that, the support member including the vessel is firmly engaged to the support region according to a specific embodiment. In a preferred embodiment, the support body and gas filled vessel are easily inserted and can replace another support body and gas filled vessel. Of course, there can be other variations, modifications, and alternatives.

Figure 7:
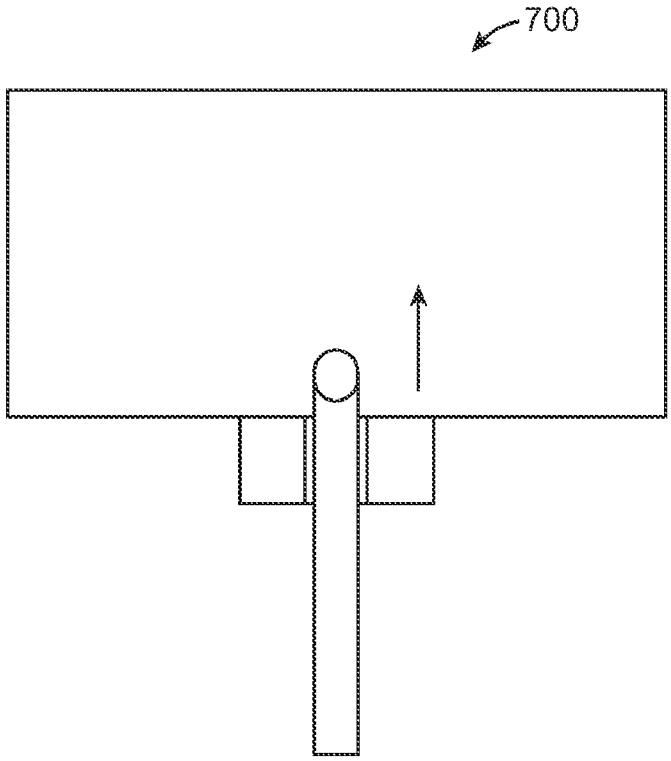
FIG. 7 is a simplified diagram of a fourth configuration of the gas filled vessel for the plasma lamp according to an alternative embodiment of the present invention.

FIG. 7 is a simplified diagram 700 of a fourth configuration of the gas filled vessel for the plasma lamp according to an alternative embodiment of the present invention. This diagram is merely an example, which should not unduly limit the scope of the claims herein. One of ordinary skill in the art would recognize other variations, modifications, and alternatives. As shown, the support body and gas filled vessel are inserted together by sliding the support body through the lower region of the housing. In a specific embodiment, attachment devices that have been disengaged from the support body are engaged. After that, the support body including the vessel is firmly engaged to the support region according to a specific embodiment. In a preferred embodiment, the support body and gas filled vessel are easily inserted and can replace another support body and gas filled vessel. Of course, there can be other variations, modifications, and alternatives.

In a specific embodiment, a method for removing a gas filled vessel may be outlined as follows:

1. Start, step 801;
2. Provide a plasma lamp apparatus comprising a housing having a spatial volume defined within the housing, step 803;
3. Remove (step 805) a securing device to decouple a first lamp device comprising a first gas filled vessel (which is non-working) coupled to a first support body disposed within or partially disposed from a support region coupled to an inner region of the housing;
4. Remove (step 807) the first lamp device comprising the first gas filled vessel coupled to the first support body disposed within or partially disposed the support region of the housing from the support region, while the support body remains coupled to the first lamp device;
5. Free (step 809) the first lamp device coupled to the support body;
6. Decouple (step 811) the first lamp device from the support body; and
7. Perform other steps as desired.

The above sequence of steps provides a method according to an embodiment of the present invention. In a specific embodiment, the present invention provides a method for removing a non-working or defective bulb and fill from a plasma lamp assembly. Other alternatives can also be provided where steps are added, one or more steps are removed, or one or more steps are provided in a different sequence without departing from the scope of the claims herein. Details of the present method and structure can be found throughout the present specification and more particularly below.

Figure 8:
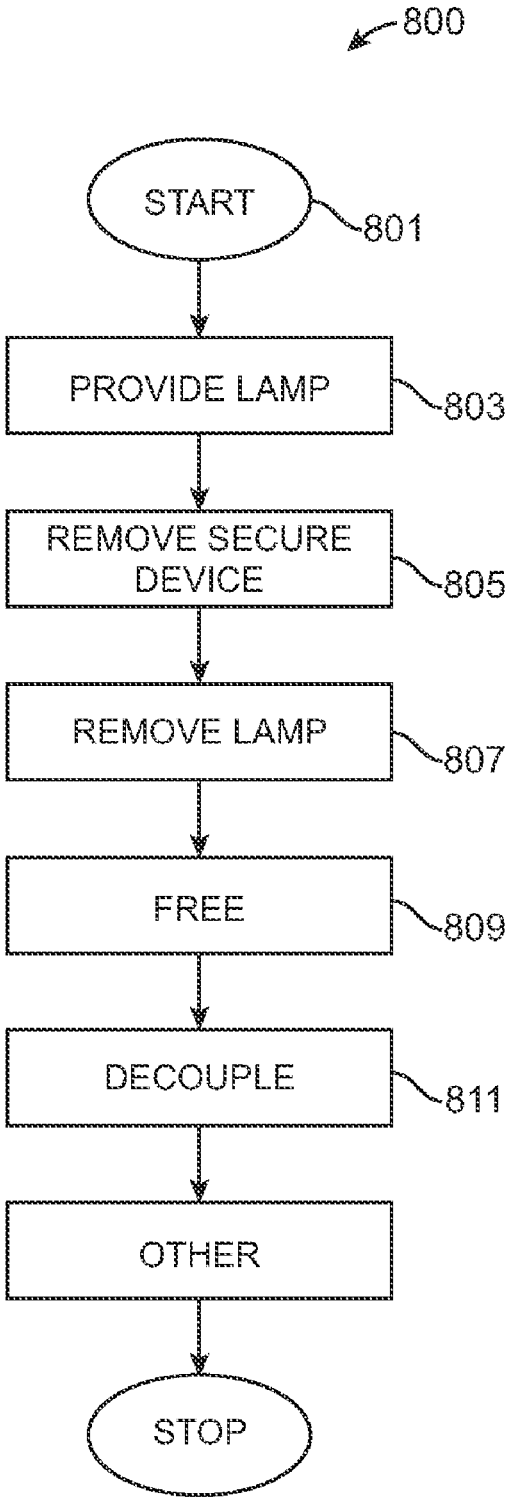
FIG. 8 is a simplified diagram of a method of removing a gas filled vessel according to an embodiment of the present invention.

FIG. 8 is a simplified diagram of a method of removing a gas filled vessel according to an embodiment of the present invention. This diagram is merely an example, which should not unduly limit the scope of the claims herein. One of ordinary skill in the art would recognize other variations, modifications, and alternatives.

In a specific embodiment, a method for removing and replacing gas filled vessel may be outlined as follows:

1. Start, step 901;
2. Provide a plasma lamp apparatus comprising a housing having a spatial volume defined within the housing, step 903;
3. Remove (step 905) a securing device to decouple a first lamp device comprising a first gas filled vessel (which is non-working) coupled to a first support body disposed within or partially disposed from a support region coupled to an inner region of the housing;
4. Remove (step 907) the first lamp device comprising the first gas filled vessel coupled to the first support body disposed within or partially disposed the support region of the housing from the support region, while the support body remains coupled to the first lamp device;
5. Free (step 911) the first lamp device coupled to the support body;
6. Decouple (step 913) the first lamp device from the support body;
7. Insert (step 915) a second lamp device comprising a second gas filled vessel coupled to a second support body to a region within or partially within the support region of the inner region of the spatial volume of the housing;
8. Engaging (step 917) the securing device to firmly engage the second lamp device to the support region of the plasma lamp assembly; and
9. Perform (step 919) other steps as desired.

The above sequence of steps provides a method for removing and replacing gas filled vessel for a lamp device according to an embodiment of the present invention. In a specific embodiment, the present invention provides a method for removing and replacing a non-working or defective bulb and fill from a plasma lamp assembly. Other alternatives can also be provided where steps are added, one or more steps are removed, or one or more steps are provided in a different sequence without departing from the scope of the claims herein. Details of the present method and structure can be found throughout the present specification and more particularly below.

Figure 9:
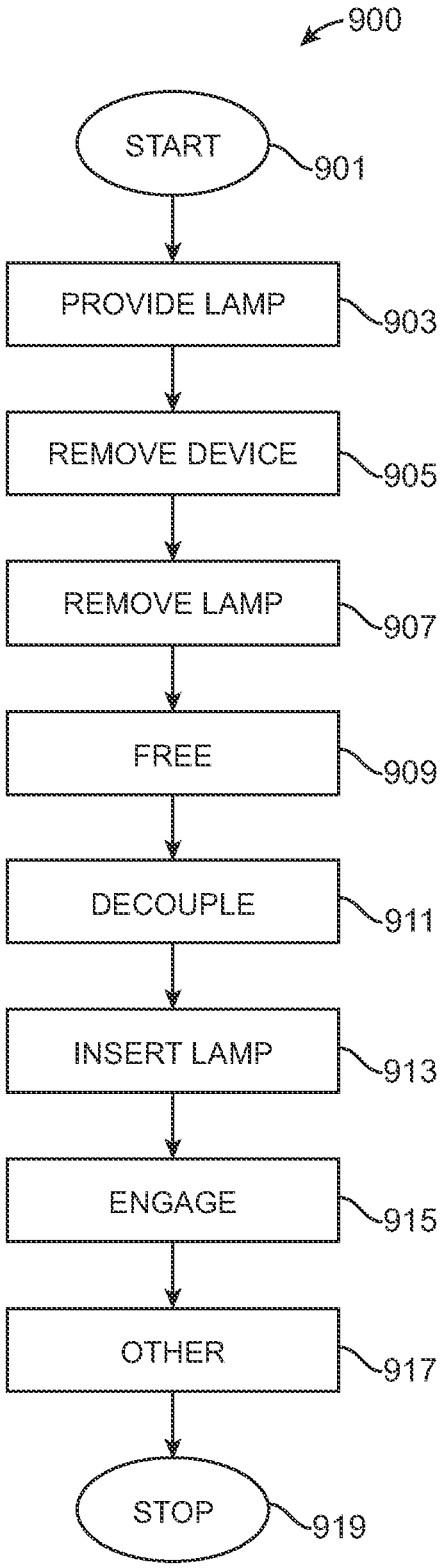
FIG. 9 is a simplified diagram of a method of replacing a gas filled vessel according to an embodiment of the present invention.

FIG. 9 is a simplified diagram of a method of removing and replacing a gas filled vessel according to an embodiment of the present invention. This diagram is merely an example, which should not unduly limit the scope of the claims herein. One of ordinary skill in the art would recognize other variations, modifications, and alternatives.

While the above is a full description of the specific embodiments, various modifications, alternative constructions and equivalents may be used. Therefore, the above description and illustrations should not be taken as limiting the scope of the present invention which is defined by the appended claims.

What is claimed is:

1. A method of replacing a bulb on plasma lamps, the method comprising:

providing a plasma lamp apparatus comprising a housing having a spatial volume defined within the housing, the spatial volume having an inner region, the plasma lamp assembly also having a support region coupled to the inner region of the spatial volume;

removing a first lamp device comprising a first gas filled vessel detachably coupled to a first support body disposed within or partially disposed the support region of the housing;

inserting a second lamp device comprising a second gas filled vessel detachably coupled to a second support body to a region within or partially within the support region of the inner region of the spatial volume of the housing; and coupling the second support body to the housing to firmly engage the second lamp device to the support region of the plasma lamp assembly.

2. The method of claim 1 wherein the support region firmly engages an end of the second support body.

3. The method of claim 1 wherein the support region is disposed within a lower region of the housing.

4. The method of claim 1 wherein the second lamp is coupled to an rf source, the rf source being configured to cause a discharge from gas within the second gas filled vessel.

5. The method of claim 1 wherein the inserting comprising sliding an end of the second body into the support region.

6. The method of claim 1 wherein the removing comprising sliding an end of the first support body out of the support region.

7. The method of claim 1 wherein the support region comprises an attachment device.

8. The method of claim 7 wherein the attachment device comprises one or more set screws.

9. The method of claim 7 wherein the attachment device comprises one or more clamps.

10. The method of claim 1 wherein the support region is coupled to a dielectric material operably coupled to the second support body.

11. The method of claim 1 wherein the first support body is the second support body.

* * * * *